US005606774A

United States Patent [19]

Wu

[11] Patent Number: 5,606,774

[45] Date of Patent: Mar. 4, 1997

[54] STRUCTURE OF DOOR HINGE

[76] Inventor: Chien-Cheng Wu, 7F-2, No. 95-8 Chang Ping Road, Sec. 1, Taichung, Taiwan

[21] Appl. No.: 590,631

[22] Filed: Dec. 8, 1995

[51] Int. Cl.[6] ..... F05D 3/06

[52] U.S. Cl. ..... 16/366; 16/50; 16/283

[58] Field of Search ..... 16/366, 49, 50, 16/68, 54, 282, 283, 285, 280, 287

[56] References Cited

U.S. PATENT DOCUMENTS

| | | | |
|---|---|---|---|
| 727,697 | 5/1903 | Sargent | 16/283 |
| 966,380 | 8/1910 | Bommer | 16/283 |
| 1,138,484 | 5/1915 | Katzenberger | 16/283 |
| 1,525,397 | 2/1925 | Keene | 16/283 |
| 2,924,843 | 3/1960 | Tykeson | 16/280 |
| 3,118,167 | 1/1964 | Morris et al. | 16/54 |
| 5,382,253 | 1/1995 | Lin | 16/50 |

*Primary Examiner*—Chuck Y. Mah

[57] ABSTRACT

A double tubed door hinge for automatically closing a door comprises a two-tube base, a pair of torsion springs disposed to respective tubes therein and urged at two ends by a pair of first twisting members and a pair of second twisting members, and retained by a pair of lug members and a pair of axle rods. The improvement has been characterized in that an annular sleeve is placed between the first twisting member and the upper rim of the tube and a splitting small tube disposed into the first and second twisting members. In addition to that both the twisting members and the annular sleeve are made from reinforced plastic material and the splitting small tube is made from anti-friction material. So that the door hinge is durable and provides a smooth operation without causing any noise.

10 Claims, 7 Drawing Sheets

STRUCTURE OF DOOR HINGE

BACKGROUND OF THE INVENTION

The present invention relates to hinges, and more particularly to a structurally improved door hinge which ensures more easy and smooth operation and will not be askew or deformed, therefore durability.

Prior art door hinge as shown in FIG. 1 which generally comprises a double tubed base 10, a pair of torsion springs 12 placed in the tubes 11, which end of the tubes 11 is rotatably engaged a twisting member 13 or 13' each has a slot 131 on lower portion for anchoring the ends 121 of the spring 12 and a plurality of transverse recesses 132 spacedly formed around the outer periphery of the upper portion of the twisting member 13 for adjusting the tensions of the spring 12 by a dowel pin 14, a pair of lug members 20 coupled with the base 10 on their ears 21 in alignment with the ends of the tubes 11 and a threaded rod 22 inserted through the center of the tube 11 and exposed to outside the ears 21 and then fastened by a pair of cap nuts 23. Therefore a door hinge of the prior art is constructed as shown in FIG. 2. This door hinge provides automatic door closing for the exertion of the tension force energised in the pair of torsion springs 12. However, the twisting member 13 thereof is currently made of metal material which is expensive and difficult to manufacture. Furthermore, the rigid surface of its stepped upper portion which is pressedly engaged within the tube 11 will enlarge the caliber of the tube 11 during frequent swinging the twisting member 13 therein and deforms the hinge so as to tend to skew the door after all. Besides, the twisting member 13 is axially engaged with the threaded rod 23 which is also made of metal material, the swinging between them will cause frictional noise. If there is any split in the slot 131, it will be breakable for the torsion force of the spring 12.

SUMMARY OF THE PRESENT INVENTION

The main object of the present invention is to provide a structure of door hinge which has reinforcement and anti-friction device in order to ensure the hinge to be durable and smooth to operate.

Another object of the present invention is to provide a structure of door hinge which is relatively inexpensive to manufacture.

Accordingly, the door hinge of the present invention utilizes reinforced plastic material instead of the metal to produce the twisting members. The twisting member each has a small metal tube axially inserted in the central hole thereof and an annular sleeve matted on the internal portion for smooth operation and obviating noise caused by material friction.

The present invention will become more fully understood by reference to the following detailed description thereof when read in conjunction with the attached drawings.

DETAILED DESCRIPTION OF THE PREFERRED EMBODIMENT

Figure 1:
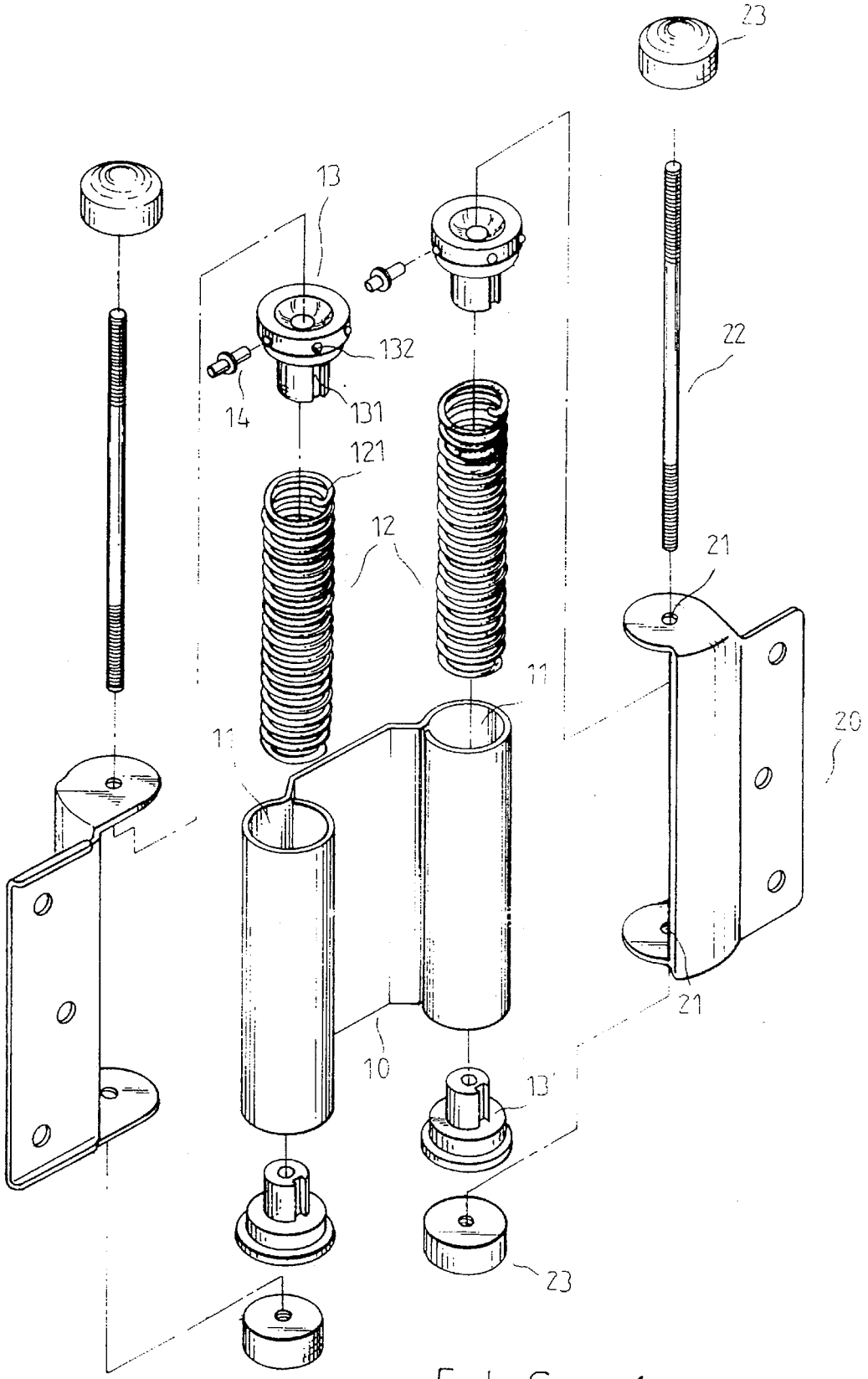
FIG. 1 PRIOR ART
FIG. 1 is an exploded perspective view to show a door hinge of the prior art.
Figure 2:
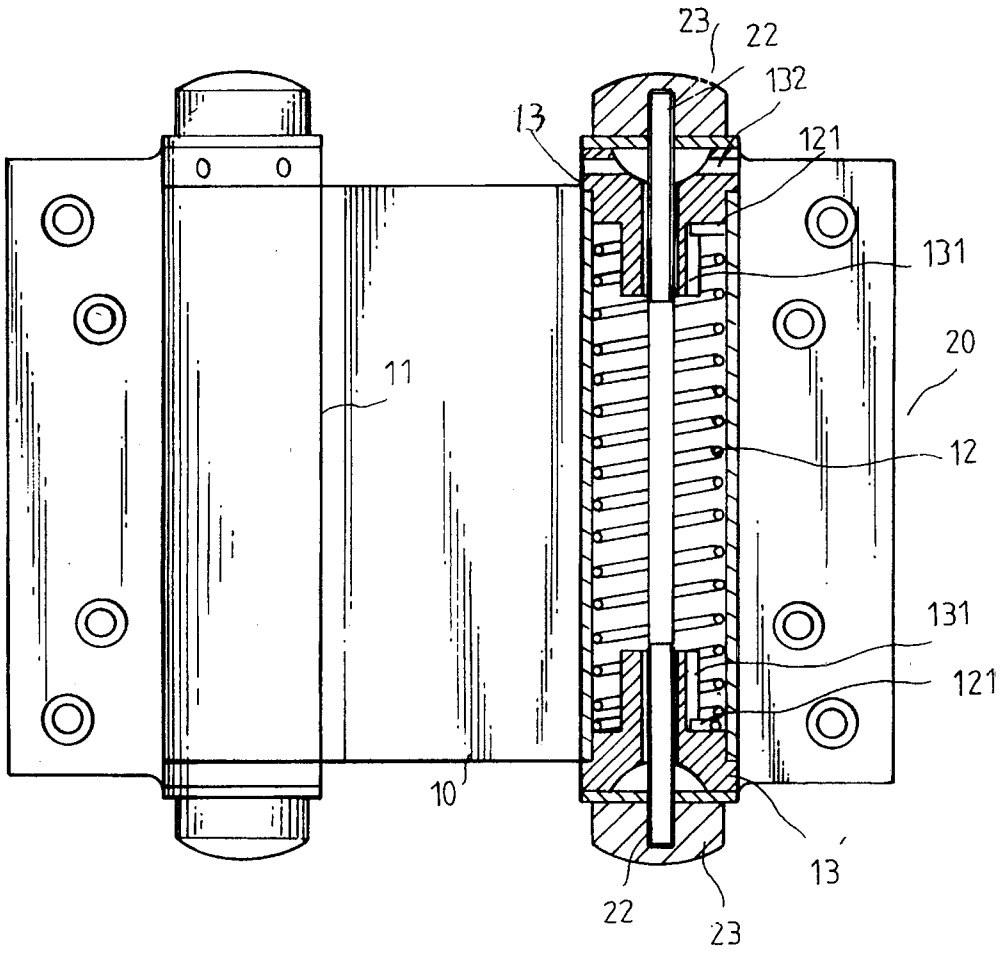
FIG. 2 PRIOR ART
FIG. 2 is an assembled door hinge of FIG. 1.
Figure 3:
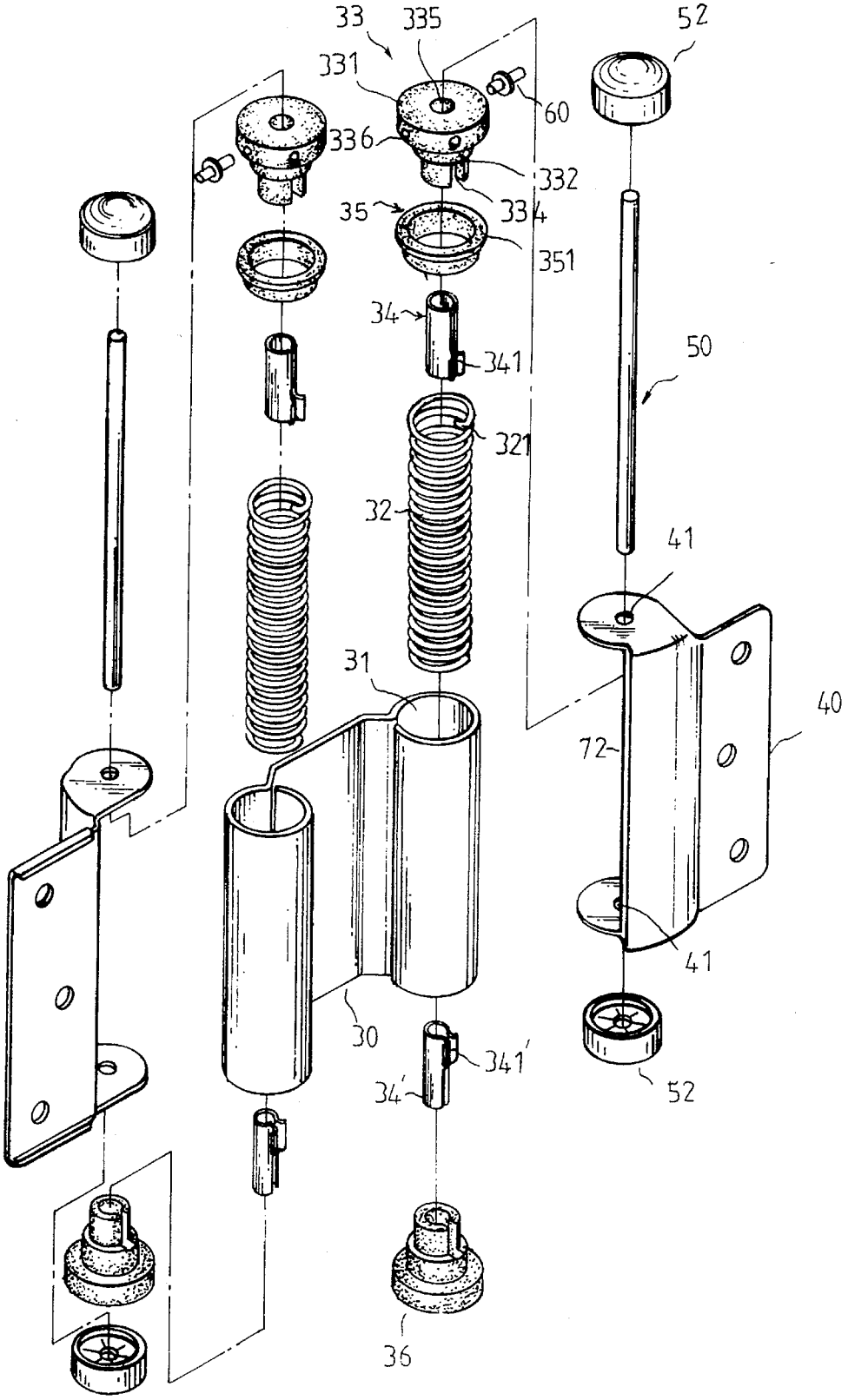
FIG. 3 is an exploded perspective view to show a door hinge of the preferred embodiment of the present invention.
Figure 3A:
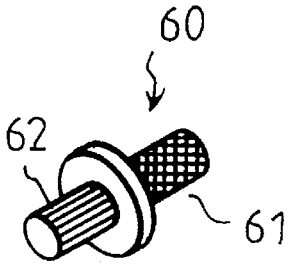
FIG. 3A and 3B are the perspective views to show the dowel pin and the splitting small tube engaged with a twisting member therein.
Figure 3B:
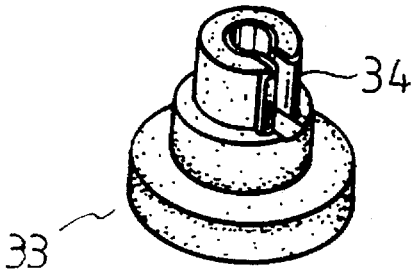

With reference to FIGS. 3, 3A and 3B of the drawings, the door hinge of the present invention comprises a rectangular base 30 having integrally formed a pair of tubes 31 on two lateral ends respectively, a pair of torsion springs 32 respectively disposed in the pair of tubes 31, a pair of the first twisting members 33 incooperated with a pair of splitting small tube 34 and a pair of annular sleeves 35 rotatably engaged within the upper ends of the tubes 31, a pair of second twisting members 36 incooperated with a pair of splitting small tubes 34' engaged within the lower ends of the tubes 31, a pair of lug members 40 aligned on their recessed ears 41 with respective the ends of the tubes 31 and abutting the outer surface of the twisting members 33 and 36 and a pair of axle rods 50 axially inserted through the tubes 31 respectively with their end exposed to outside the ends of the tubes 31 and secured by means of the cap members 52. Finally, a pair of dowel pins 60 insert into one of the recesses 336 on each of the first twisting members 33 to rotate them to adjust the tention force of the springs 32 and then urged themselves against the ears 41 respectively.

The dowel pin 60 has peripheral twills 61 on inward end made for stable securing in the recess 336 and a splined periphery on outward end for readily pinching with fingers, as shown in FIG. 3A.

The first twisting member 33 which is made from reinforced plastic material has a circular body 331 diametrically equaled to that of the tube 31, a two- stepped extension 332 axially projected from one side thereof, a longitudinal split 334 on the peripheral wall of a less diameter portion of the extension 332, an axle hole 335 centrally formed through the body and a plurality of recesses 336 spaced apart around the outer periphery of the circular body 331.

The annular sleeve 35 which is also made from reinforced plastic material has a flange 351 diametrically equaled to the tube 31 so as to stop on the rim of the tube 31 when the sleeve 35 is pressed in.

The splitting small tube 34 or 34' which is made from frictionless metal has a grip 341 or 341' laterally extended from the lower portion of the split including a pair of jaws and sightly outward from each other aslant for clamping the distal 321 of the spring 32 therein. The outer diameter of the small tube 34 equals to the inner diameter of the axle hole 35 of the twisting member 33 so as to fit in hole 35 with the grip 341 or 341' exposed to outside the split 334 of the twisting member 33 (as shown in FIG. 3B).

The second twisting member 36 which is also made from reinforced plastic material has a shape identical to the first twisting member 33 with exception of the peripheral recesses 336.

Figure 4:
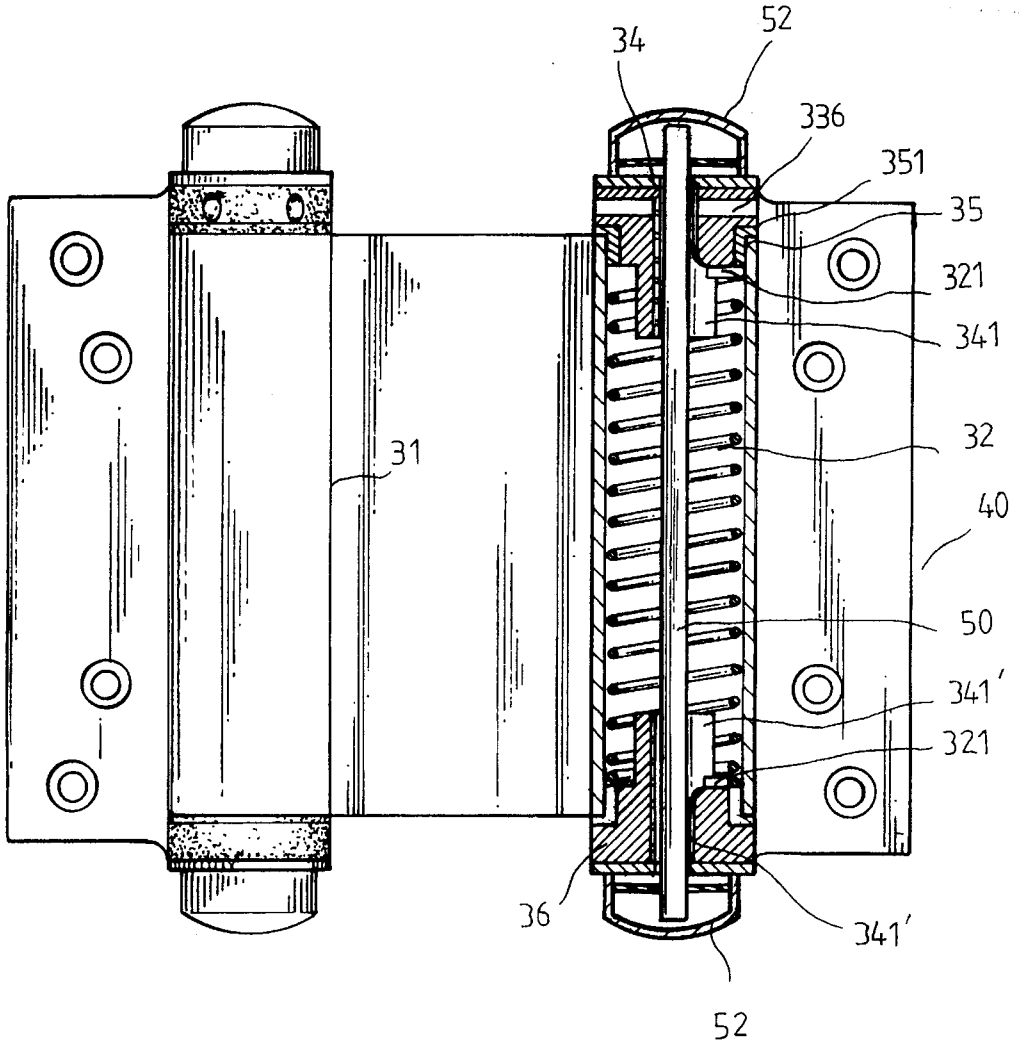
FIG. 4 and 4A are the assembled door hinge of FIG. 3.
Figure 4A:
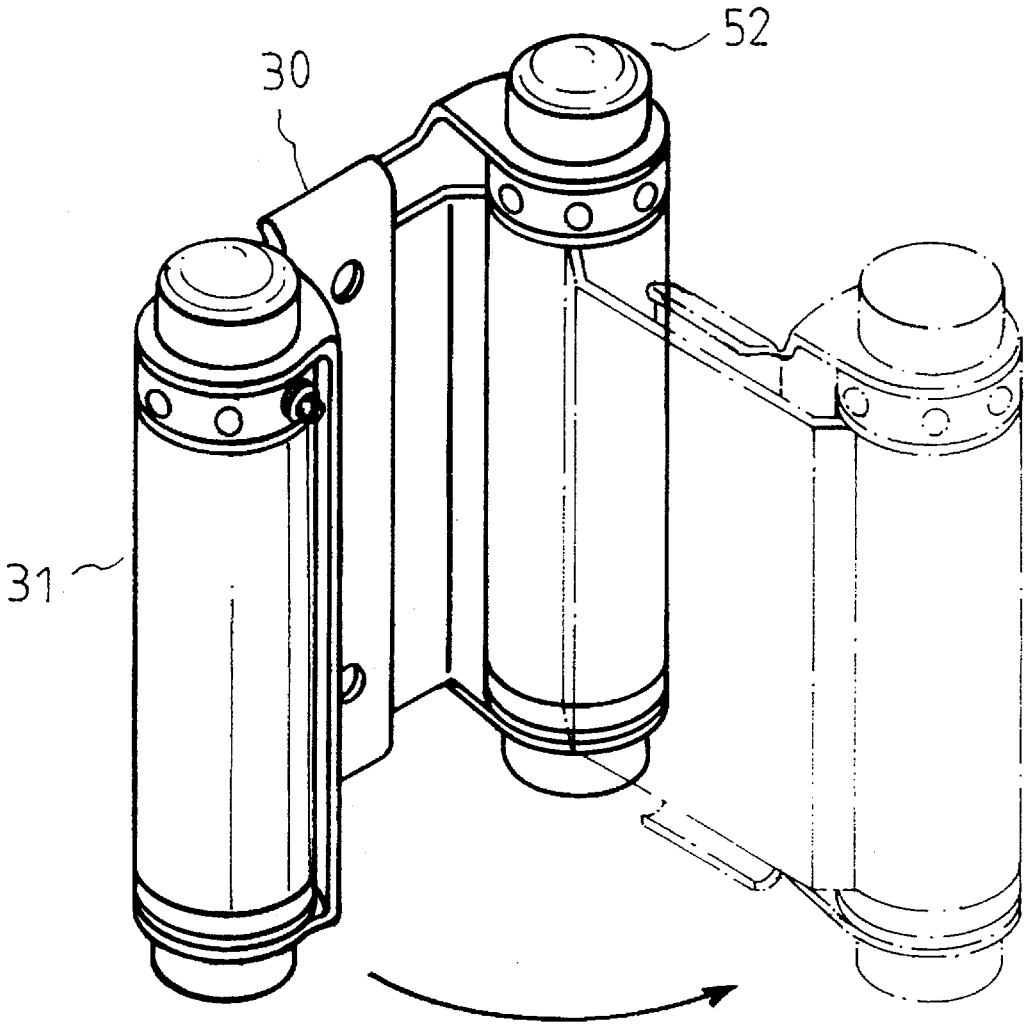

Referring to FIG. 4 and 4A, when the hinge is assembled, the annular sleeve 35 fits between the tube 31 and the twisting member 33 so as to prevent the rim of the tube 31 from deformation or to be worn away. Where the splitting small tube 34 prevents the axle rod 50 from directly engaging with the twisting member 33 in order to obviate friction therebetween.

Figure 5:
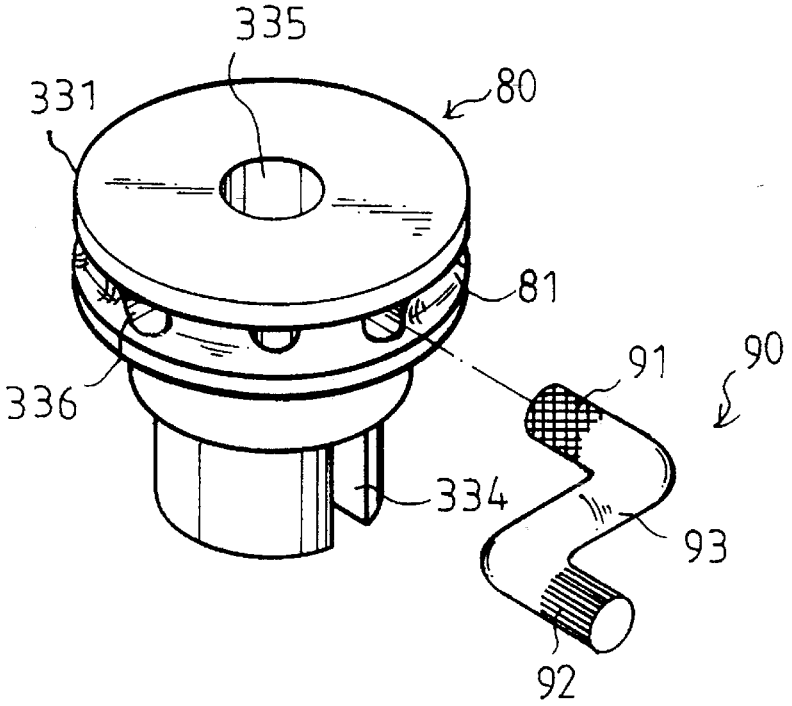
FIG. 5 is a perspective view to show an alternative embodiment of a first twisting member and a dowel pin of the present invention.

Referring to FIG. 5, an alternative embodiment of a first twisting member 80 and a Z-shaped dowel pin 90 is shown.

The first twisting member 80 has an annular groove 81 formed on the outer periphery of the circular body 331 across the recesses 336. The Z-shaped dowel pin 90 has also peripheral twills 91 on an inward end and a splined periphery 92 on an outward end. When the inward end inserts into the recess 336, the transverse portion of the Z-shaped is received into groove 81 and the outward end 92 thereof urges against the ears 41 of the lug member 40.

This arrangement will obviate the opening of the recess 336 from marred of torsion force of the dowel pin 60 and that the Z-shaped dowel pin 90 will be protected by the lateral edge of the lug member 40 from loosened up.

Based on aforediscussed improvement, the door hinge of the present invention ensures smoothly automatic closing of a door without causing any noise or deformation.

Note that the specification relating to the above embodiment should be construed as exemplary rather than as limitative of the present invention, with many variations and modifications being readily attainable by a person of average skill in the art without departing from the spirit or scope thereof, as defined by the appended claims and their legal equivalents.

I claim:

1. A hinge for automatically closing a door comprising:

a rectangular base integral with a pair of tubes on two lateral sides respectively;

each of said tubes having a torsion spring disposed therein, an annular sleeve having a flange fit to an upper rim thereof, a first twisting member including a splitting small tube therein for clamping a distal portion of said spring, said first twisting member being inserted into an upper end of said tube and a circular body thereof abutting against said annular sleeve, a second twisting member including a splitting small tube therein for clamping another distal portion of said spring, said second twisting member being inserted into a lower end of said tube with a circular body thereof abutting against a rim of said lower end;

a pair of lug members each having a pair of recessed ears aligned with two ends of said respective tubes and abutting an outer surface of said first and second twisting members;

a pair of axle rods axially inserted through said respective tubes with their two ends exposed to outside said ears and secured by means of cap members;

a pair of dowel pins for fixing said first twisting member against the ears of said lug members and urging said torsion springs are inserted into a peripheral recess of said respective first twisting members.

2. The hinge as recited in claim 1, wherein said first and second twisting members are made from a reinforced plastic material.

3. The hinge as recited in claim 2, wherein said said first and second twisting members each has a circular body and a two-stepped extension axially projected from one side thereof, an axle hole centrally formed therethrough and a split on a peripheral wall of a small diametral lower poriton of said extension.

4. The hinge as recited in claim 3, further has a plurality of peripheral recesses spaced apart around an outer periphery of the circular body of each said first twisting member.

5. The hinge as recited in claim 3, wherein said first twisting member further has an annular groove on an outer periphery of it's circular body.

6. The hinge as recited in claim 5, wherein said dowel pins are Z-shaped.

7. The hinge as recited in claim 1, wherein said annular sleeve is made from reinforced plastic material.

8. The hinge as recited in claim 1, wherein said splitting small tube is made from anti-friction material.

9. The hinge as recited in claim 8, wherein said splitting small tube has a split on a peripheral wall along the length thereof and a grip extended transversely from a lower portion of said split having a pair of jaws slightly aslant outward from each other.

10. The hinge as recited in claim 1, wherein said dowel pin has peripheral twill on an inward end and a splined periphery on outward end.

* * * * *